United States Patent [19]

Reich

[11] 4,347,937

[45] Sep. 7, 1982

[54] MACHINE FOR SORTING OBJECTS BY SIZE

[75] Inventor: Robert R. Reich, Odessa, Mo.

[73] Assignee: Triple R Designs, Inc., Odessa, Mo.

[21] Appl. No.: 186,190

[22] Filed: Sep. 11, 1980

[51] Int. Cl.[3] ..... B07C 5/06

[52] U.S. Cl. ..... 209/622; 209/629; 209/665

[58] Field of Search ..... 209/44.1, 606, 621, 209/622, 659, 629, 632, 660, 674, 665

[56] References Cited

U.S. PATENT DOCUMENTS

| | | | |
|---|---|---|---|
| 1,337,257 | 4/1920 | O'Quinn . | |
| 1,385,218 | 7/1921 | McIntyre . | |
| 1,448,689 | 3/1923 | Hatch . | |
| 1,710,199 | 4/1929 | White | 209/622 |
| 3,038,605 | 6/1962 | Durand | 209/622 |
| 3,206,024 | 9/1965 | Blake . | |
| 3,525,430 | 8/1970 | Bruel et al. . | |
| 3,561,597 | 2/1971 | Youngblood | 209/622 |

FOREIGN PATENT DOCUMENTS

| | | | |
|---|---|---|---|
| 126317 | 1/1948 | Australia | 209/622 |

*Primary Examiner*—Allen N. Knowles

*Attorney, Agent, or Firm*—Schmidt, Johnson, Hovey & Williams

[57] ABSTRACT

A machine for sorting objects, such as for instance mushrooms, depending upon the size of the object includes an elongated supporting frame, a continuous carrier chain extending longitudinally on each side of the frame, there being apparatus for synchronously driving the chains, and a plurality of spaced, transversely extending rods spanning the distance between the chains and carried thereby for movement therewith, there being a finger member carried by each of the rods in swingable engagement therewith, each finger member having an upper hook portion engaging the rod, a lower edge portion and an intermediate arcuate portion between the hook and the edge. A toothed guide strip is provided and extends longitudinally adjacent one of the carrier chains in a position to engage the lower edge portions of the finger members as they are moved longitudinally of the machine when the chains are driven, to impart vibrating movement to the finger members to thus facilitate the objects to be sorted in falling through spaces between the finger members, such spaces successively increasing in size as the fingers are moved from an object receiving end of the machine to the opposite end thereof, all to the end that the objects may be accumulated in baskets positioned beneath the fingers in graded sizes, from smaller sizes to larger sizes.

8 Claims, 6 Drawing Figures

MACHINE FOR SORTING OBJECTS BY SIZE

TECHNICAL FIELD

The machine disclosed herein is particularly intended for sorting objects by size and specifically objects such as mushrooms or other fruits or vegetables, which must be graded and sorted prior to packaging and shipment, the sorting dividing the objects into groups of similar size, whereby they may be packaged and/or sold depending upon the size of the object.

BACKGROUND ART

Various machines have been devised for sorting objects of varying sizes whereby to accumulate groups of the objects in containers, by size. Such machines have taken the form of longitudinally extending conveyors having rods which initially support the objects to be sorted and which rods are positioned in such a manner that the space therebetween grows larger as the objects travel therealong whereby to sort the objects by size as a result of the objects being successively able to fall through larger spaces between the rods. For instance, U.S. Pat. No. 1,337,257 contemplates a sizer and grader for objects not of perfectly spherical form such as for instance, lemons, tomatoes, apples and similar fruits or vegetables. U.S. Pat. No. 1,385,218 discloses a sizing machine for peaches and other fragile fruits and wherein rods carried by the conveyor are successively spaced a larger distance apart to sort the objects. U.S. Pat. No. 1,448,689 discloses a fruit sizing machine which has an adjustable guide member to permit rollers to be spaced apart a greater distance as they move from the object receiving end of the machine towards the opposite end thereof. Other art in the field includes U.S. Pat. Nos. 1,489,585, 3,206,024 and 3,525,430.

SUMMARY OF THE PRESENT INVENTION

The present invention relates to a machine for sorting objects by size and has been specifically developed for the grading and sorting of mushrooms which, when picked, are in various sizes and are of an irregular, generally ovoidal shape. It is desired to grade and sort the mushrooms, prior to packaging or shipment so that groups of mushrooms of approximately the same size may be packaged and sold together.

To this end, there is provided a machine having an elongated supporting frame which carries a pair of carrier chains on each side of the frame, the chains being synchronously driven and having a plurality of spaced rods spanning the distance between the chains for movement therewith.

A finger member is provided for each of the rods and depends therefrom in swingable relationship, each of the finger members being provided with an upper hook portion for swingable engagement with its corresponding rod, a lower edge portion and an intermediate arcuate portion between the hook and the edge, the convex face of the intermediate arcuate portion of each of the fingers being toward said opposite end of the machine during the sorting operation.

In order to facilitate the movement of the mushrooms or similar objects through the spaces between the fingers, as the machine is operated, and into receiving baskets, there is provided a guide strip which extends longitudinally adjacent one of the carrier chains and in a position to engage the lower edge portion of the finger members as they are driven longitudinally of the machine, the guide strip having teeth thereon which, by engagement with the finger members, impart a vibratory action thereto, this tending to shake the mushrooms through the spaces between the finger members.

The guide strip, as indicated, has a plurality of teeth and the teeth increase in height and also in length as they progress along the strip from the object receiving end of the machine toward the opposite end of the machine, whereby a greater vibratory action is imparted to the fingers at the commencement of their sorting path and a lesser vibratory action is imparted toward the end of such path when the larger objects are falling through the spaces between the fingers.

The guide strip is angularly adjustable whereby to permit greater swinging movement of the fingers as they move through their path of sorting travel whereby greater spacing will be permitted between the fingers as they move along the length of the machine, the successive increase in spacing permitting the mushrooms or similar objects to be sorted from smaller sizes to larger sizes.

Other important objects of the invention will become apparent from the following specification.

DETAILED DESCRIPTION

Figure 1:
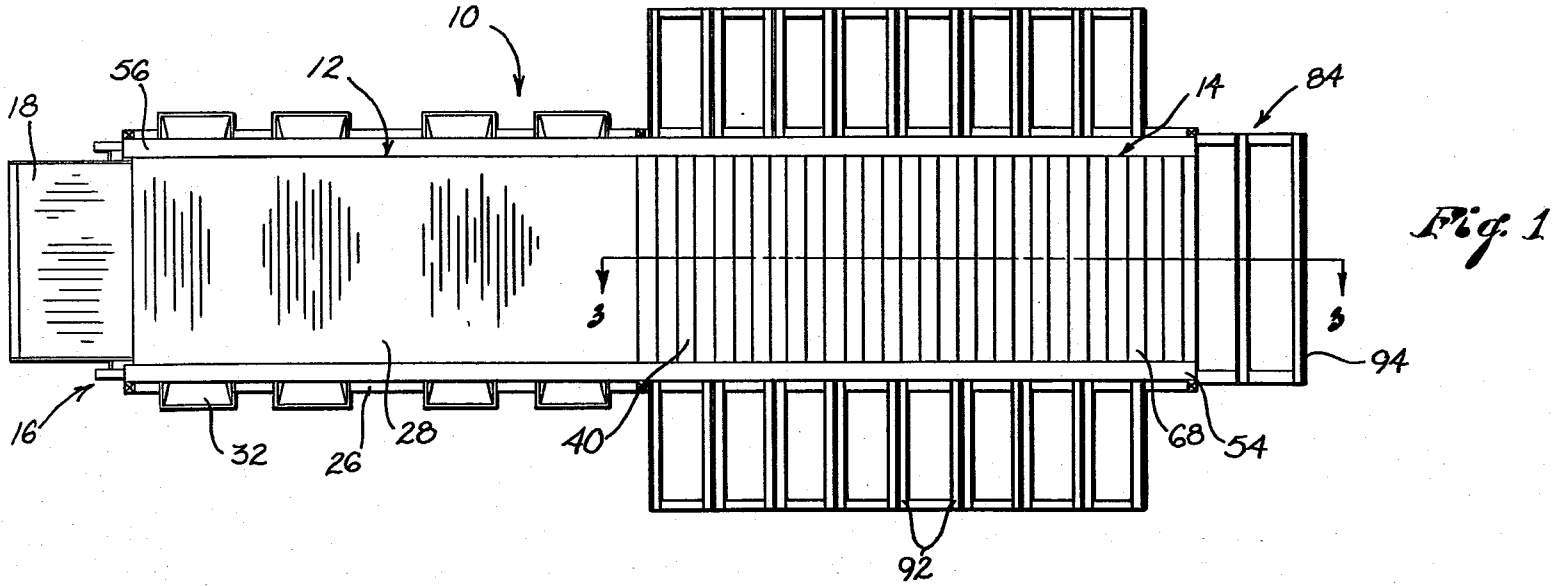
FIG. 1 is a top plan view of the machine for sorting objects by size.
Figure 2:
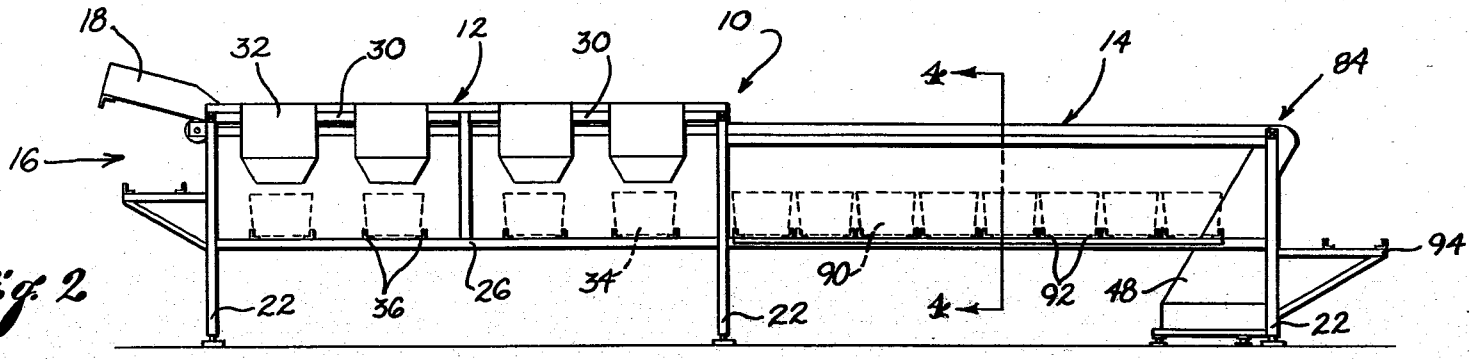
FIG. 2 is a side elevational view of the machine, portions being shown in dashed lines for purposes of illustration.

The machine for sorting objects by size is generally designated by the numeral 10 and broadly includes a grading area 12 and a sorting area 14, best shown in FIGS. 1 and 2 of the drawing.

The object receiving end 16 of the machine 10 is provided with a loading chute 18 by which the mushrooms or other similar objects to be sorted may be delivered onto the machine and particularly into the grading area thereof.

The entire machine is supported by a longitudinally extending frame 20 having a plurality of upright legs such as 22 and suitable transversely extending crossbars 24 as well as longitudinal bars 26 whereby to suitably support the apparatus of the grading area 12 and sorting area 14 of the machine 10.

The grading area 12 includes conveyor means such as 28 which may be comprised of a screen-like material or a plurality of closely spaced rods, suitable for supporting the mushrooms or the like and whereby any dirt or other foreign matter which is in the objects to be sorted may be permitted to pass through the screen or between the rods of conveyor 28, such conveyor moving from left to right viewing FIGS. 1 and 2 of the drawing.

A number of dirt receiving pans such as 30 are positioned beneath the conveyor 28 whereby to accumulate the dirt and other foreign material which is among the mushrooms when they are placed on conveyor 28 over loading chute 18.

It is desirable that the conveyor 28 be made of a number of rods which are spaced apart and have sufficient distance therebetween to permit the undesirable "cull" mushrooms to pass therebetween and down chutes 32 into cull baskets 34 which are positioned respectively beneath the chutes 32 and are supported by suitable trackways such as 36, which trackways span the transverse distance between longitudinal bars 26 of the frame 20.

Thus, as the mushrooms are moved along the grading area by the conveyor 28, the undesirable small "cull" mushrooms will be dropped between the rods and into baskets 34 through chutes 32 and any other foreign material, dirt or unwanted objects will also be graded out of the mushrooms to be sorted whereby only clean mushrooms of a desired size range are delivered, from the conveyor 28 into the sorting area 14.

The sorting area 14 is also provided with means for conveying the mushrooms in the general form of a sorting stretch 38 of a conveyor 40, it being noted that conveyor 40 is separated from conveyor 28 and, as shown in FIG. 2 is disposed in a slightly different horizontal plane than is the conveyor 28.

Conveyor 40 is in the form of continuous carrier chains 42 and 44, each chain extending longitudinally of a corresponding side of the elongated supporting frame 20 and having the aforementioned sorting stretch 38 and a return stretch 46, the chains 42 being driven by a suitable power source (not shown) which is enclosed within a housing such as 48 and is coupled with chains 42 and 44 through suitable gears, sprockets, shafts and the like in a conventional manner all to the end that chains 42 and 44 may be synchronously driven by the power source.

Figure 4:
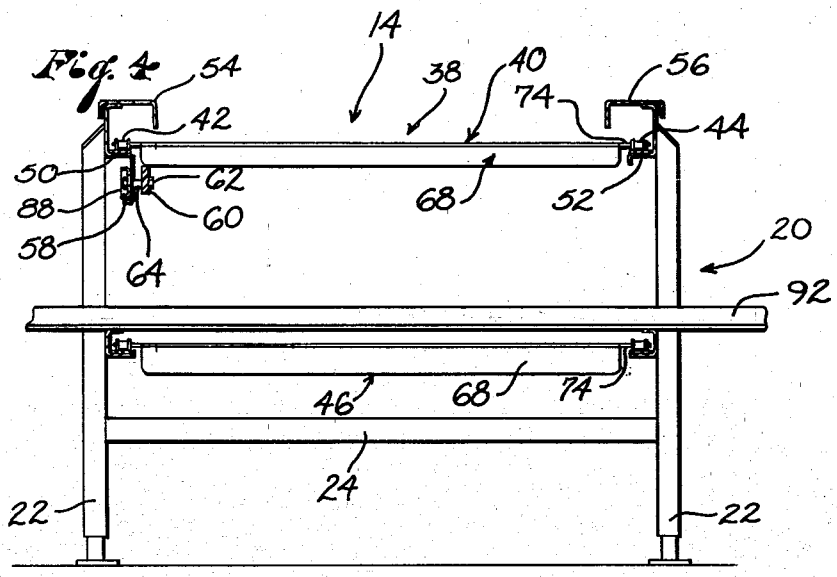
FIG. 4 is a sectional view taken on line 4—4 of FIG. 2.

A trackway is provided for each of the chains, such as that shown in FIG. 4., the trackway for chain 42 being designated as 50 and the trackway for chain 44 being designated as 52. Each of the trackways is provided with a suitable wear strip, preferably of plastic material, and which directly supports the driven chain.

Trackway 50 is protected by a chain guard 54 and trackway 52 by a guard 56, it being noted that the trackways 50 and 52 are supported by the upper ends of the legs 22 of the frame 20 and said trackways extend the length of the machine at the sorting end or area thereof 14.

In the embodiment illustrated, the chain guard 54 which corresponds to chain 42, is provided with a downwardly extending flange 58, which flange 58 is used to mount, in spaced relation therefrom, a guide strip 60, the guide strip 60 being secured to the flange 58 by means of a plurality of bolts 62, each of the bolts having a spacer 64 surrounding the same, whereby to space the guide strip 60 inwardly from flange 58 and in a position where the teeth 66 of the guide strip are in a position to engage the lower edge of a finger member 68.

Figure 3:
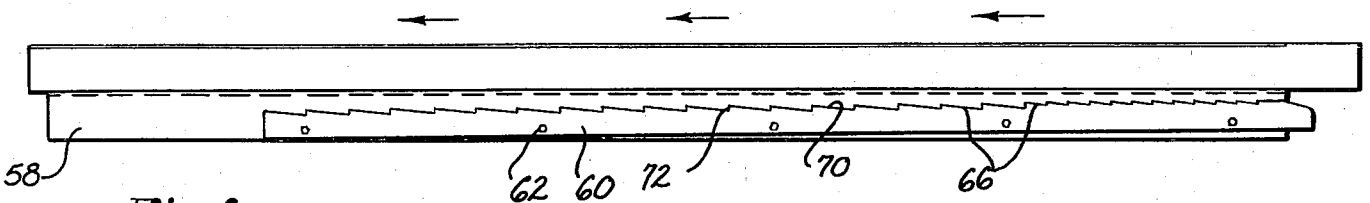
FIG. 3 is a sectional view taken on line 3—3 of FIG. 1 and showing the sorting area of the machine and particularly the guide strip which has teeth which engage the fingers as they move along the machine.

It is desirable that the guide strip 60 be angularly adjustable and to this end the flange 58 is provided with an inclined slot or opening therein, (not shown) and through which the bolts 62 pass so that the guide strip 60 may, through adjustment of the bolts 62, be inclined with respect to the horizontal, as is illustrated for instance in FIG. 3 of the drawing.

The teeth 66, provided on the upper edge of the guide strip 60 are of smaller dimensions adjacent the object receiving end of sorting stretch 38 of the machine 10 and are of a greater height and length toward the opposite end of the machine 10, all as is best shown in FIG. 3 of the drawing.

Thus each tooth has a length, such as for instance 70 and a height, such as for instance 72, there being series of teeth having the same height and length and then succeeding series of teeth 66 which have greater height and greater length as the opposite end of the machine 10 is approached.

The objects to be sorted (which are not shown in the drawing) are supported in the sorting stretch 38 by a plurality of transversely extending generally parallel rods such as 74, the rods having the opposite ends thereof connected with and carried by corresponding chains 42 and 44 whereby the rods will be driven along the length of the machine as the chains 42 and 44 are synchronously driven. The direction of movement is illustrated with arrows in FIG. 3 of the drawing.

Figure 5:
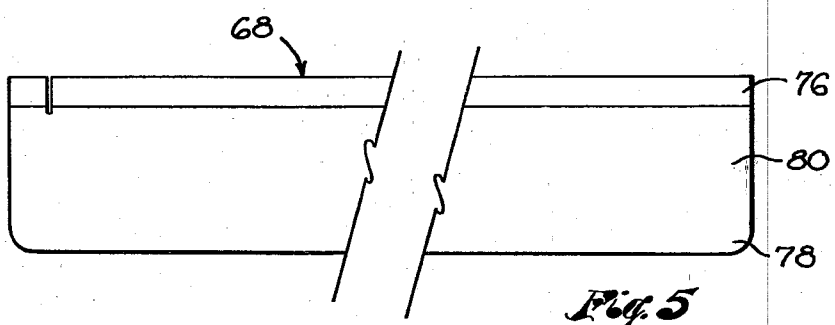
FIG. 5 is an enlarged front elevational view of one of the finger members, fragmentarily shown.
Figure 6:
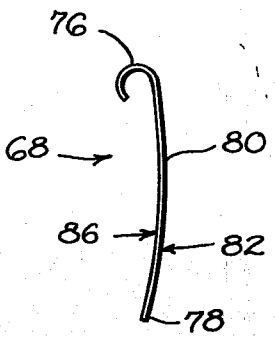
FIG. 6 is an end elevational view of a finger member.

Each of the rods 74 has a corresponding finger member 68, the finger members 68 being identical in construction and of the form best shown in FIGS. 5 and 6 of the drawing.

Thus, each of the fingers 68, which are fabricated from metal or other suitable, similar material, includes a normally upper hook portion 76 which embraces its corresponding rod 74 to swingably mount the finger 68 on its corresponding rod. Each finger also has a lower edge portion 78 and an intermediate arcuate portion 80 which is between the hook 76 and the normally lowermost edge 78.

When the machine is being operated the convex face 82 is moved toward the opposite end 84 of the machine; this being the end remote from the object receiving end 16, and the concave face 86 of each of the fingers is disposed toward said object receiving end 16.

As is apparent, the fingers 68 are of a width such as to substantially span the distance between the chains 42 and 44, as shown in FIG. 4 for instance, and each of the fingers has an area of its lower edge portion which rides along the teeth 66 of the guide strip 60 and follows a path defined by the angular disposition of the guide strip 60. To insure that the guide strip 60 is retained in its desired position of angularity, a suitable lock plate 88 corresponds to each of the bolts 62 whereby the desired angularity of the guide strip 60 may be determined and then fixed for the machine and for the particular objects being sorted.

It is desirable that the machine 10 be operated at a relatively high rate of speed and thus the driving means therefor is coupled with the chains 42 and 44 by a suitable power train and may be driven at such a speed that from 165 to 190 of the fingers 68 will be moved past a given point in a minute's time.

It has been found that such speed of movement gives a thorough sorting of the objects, particularly since the lower edges 78 of each of the fingers contact the teeth of the guide strip 60 and thus are constantly vibrated, due to the rate of speed of the machine and the nature of the fingers.

It will be appreciated that, due to the angular disposition of the guide strip 60, the fingers 68 may, as they move from the object receiving end of the machine 16 toward the opposite end 84 enjoy a greater length of swinging movement prior to engagement of the lower edge 78 of the fingers 68 with the teeth 66 of the guide strip. This serves to successively increase the spacing between the lower edges of the fingers 68 and it will be appreciated that as such spacing is increased larger objects may pass therebetween. Thus, the spacing at the start of the sorting area is smaller whereby the smaller mushrooms or the like will pass between the fingers 68 and the spacing between the fingers grows greater toward the opposite end 84 of the machine whereby the larger mushrooms will pass between the fingers.

When successively larger mushrooms pass between the fingers 68 they are free to fall into receiving baskets such as 90 which are positioned beneath the sorting area 14 and are carried by suitable trackways 92, which trackways span the distance between longitudinal bars such as 26 and serve to support the baskets 90 in complete underlying relationship to the sorting area 14. This accomplishes sorting of the mushrooms to separate baskets 90 by size and any that are too large to pass between the fingers 68 would move off of the opposite end 84 of the machine whereby they could be caught in yet a further basket which would be positioned on outwardly extending support assembly 94.

Thus, a complete sorting of an initially unsorted but graded group of objects, such as mushrooms, can be achieved at a high rate of speed due particularly to the configuration of the fingers 68 and their succeeding engagement with the teeth 66 of guide strip 60 to impart a vibratory action thereto and thus insure that mushrooms of the desired size do in fact pass between the fingers 68 in the desired stretch of the sorting area 14.

I claim:

1. A machine for sorting objects by size comprising:
an elongated supporting frame;
a continuous carrier chain extending longitudinally on each side of the frame;
means for synchronously driving said chains;
a plurality of spaced, transversely extending generally parallel rods spanning the distance between said chains and carried thereby for longitudinal movement with said chains;
a finger member carried by each of said rods, said fingers each having an upper hook portion for swingable engagement with its corresponding rod, a lower free edge portion and an intermediate arcuate portion between said hook and said free edge;
means for delivering the objects to be sorted onto the rods and fingers at the object-receiving end of the machine for movement therewith longitudinally of the machine when the chains are driven toward the opposite end of the machine; and
a toothed guide strip extending longitudinally adjacent at least one of said carrier chains and in a position to engage the lower free edge portions of said finger members as the finger members are moved longitudinally of the machine when the chains are driven whereby to impart vibrating movement to the finger members,
the teeth of said guide strip increasing in height as they progress along the strip from the object-receiving end of the machine towards the opposite end of the machine.

2. A machine for sorting objects as set forth in claim 1, the teeth of said guide strip increasing in length as they progress along the strip from the object receiving end of the machine toward the opposite end of the machine.

3. A machine for sorting objects as set forth in claim 2, said guide strip being angularly adjustable whereby to permit greater swinging movement of the fingers prior to their engagement with the strip as the fingers move from the object receiving end of the machine toward the opposite end, and therefore, successively greater spacing between the lower edges of adjacent fingers.

4. A mchine for sorting objects as set forth in claim 3, the chains being driven at a speed to move from 165 to 190 fingers past a given point in a minute's time.

5. A machine for sorting objects as set forth in claim 4, there being a plurality of removable baskets positioned beneath the rods and the fingers for receiving the objects as they fall through the successively larger spaces between said fingers.

6. A machine for sorting objects by size comprising:
an elongated supporting frame;
a continuous carrier chain extending longitudinally on each side of the frame;
means for synchronously driving said chains;
a plurality of spaced, transversely extending generally parallel rods spanning the distance between said chains and carried thereby for longitudinal movement with said chains;
a finger member carried by each of said rods, said fingers each having an upper hook portion for swingable engagement with its corresponding rod, a lower free edge portion and an intermediate paracentrical portion between said hook and said free edge; and
a saw toothed guide strip extending longitudinally adjacent at least one of said carrier chains and in a position to engage the lower free edge portions of said finger members as the finger members are moved longitudinally of the machine when the chains are driven whereby to impart vibrating movement to the finger members.

7. A machine for sorting objects by size as set forth in claim 6, each of said saw teeth having a length and a height, there being a series of teeth having the same length and height adjacent the object-receiving end of the machine and a series of saw teeth of greater height and greater length as the end of the machine opposite to the object-receiving end of the machine is approached by the guide strip.

8. A machine for sorting objects by size as set forth in claim 7, the convex face of the intermediate paracentrical portion of each of the fingers being toward said opposite end of the machine during the sorting operation, the concave face being toward the object-receiving end of the machine.

* * * * *